US006679235B1

(12) United States Patent
Skinner et al.

(10) Patent No.: US 6,679,235 B1
(45) Date of Patent: Jan. 20, 2004

(54) HIGH POWER IGNITION SYSTEM HAVING HIGH IMPEDANCE TO PROTECT THE TRANSFORMER

(75) Inventors: Albert Anthony Skinner, Anderson, IN (US); Raymond O. Butler, Jr., Anderson, IN (US); Brian Dewayne Lively, Noblesville, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/372,187

(22) Filed: Feb. 21, 2003

(51) Int. Cl.[7] ..... F02P 3/08
(52) U.S. Cl. ..... 123/620; 123/654
(58) Field of Search ..... 123/620, 654

(56) References Cited

U.S. PATENT DOCUMENTS 4,506,650 A * 3/1985 Shimojo et al. ..... 123/620
4,727,891 A * 3/1988 Schmidt et al. ..... 123/620
5,197,448 A * 3/1993 Porreca et al. ..... 123/620
5,379,745 A * 1/1995 Vogel et al. ..... 123/654
5,704,321 A 1/1998 Suckewer et al. ..... 123/143 B
6,321,733 B1 11/2001 Suckewer et al. ..... 123/620

* cited by examiner

*Primary Examiner*—Erick Solis
(74) *Attorney, Agent, or Firm*—Jimmy L. Funke

(57) ABSTRACT

An ignition system for use with a spark plug in an internal combustion engine comprising an ignition apparatus for producing a breakdown voltage on a first output thereof configured to breakdown a spark gap of the spark plug a power source having a second output configured for connection to the spark plug, said source being further configured to sustain power to the spark gap during discharge and an impedance having first and second terminals coupled between the first and second outputs, the impedance having an electrical characteristic configured to allow application of the breakdown voltage and suppress high voltage transient.

6 Claims, 2 Drawing Sheets

HIGH POWER IGNITION SYSTEM HAVING HIGH IMPEDANCE TO PROTECT THE TRANSFORMER

TECHNICAL FIELD

The present invention relates generally to ignitions systems, and more particularly to ignition coils for developing a spark firing voltage that is applied to one or more spark plugs of an internal combustion engine.

BACKGROUND OF THE INVENTION

Ignition coils are known for use in connection with an internal combustion engine such as an automobile engine, and which include a primary winding, a secondary winding, and a magnetic circuit. The magnetic circuit conventionally may include a cylindrical-shaped, central core extending along an axis, located radially inwardly of the primary and secondary windings and magnetically coupled thereto. One end of the secondary winding is conventionally configured to produce a relatively high voltage when a primary current through the primary winding is interrupted. The high voltage end is coupled to a spark plug, as known, that is arranged to generate a discharge spark responsive to the high voltage. The discharge spark causes a break down of the spark gap of the spark plug.

As ignition coils are located closer to the spark plug, a high voltage transient occurs at the breakdown of the spark gap. This high voltage transient causes a wire to wire short in the secondary winding of the ignition coil, which results in a reduction of output and in some cases, irreparable damage to the ignition coil. Accordingly, the problem of wire to wire transients occurs as a result of the gap breakdown.

Systems are being developed that use a standard ignition system to break down the gap and further include a secondary power source to provide a high power discharge. One approach taken in the art is disclosed in U.S. Pat. No. 6,321,733 ('733 Patent) and U.S. Pat. No. 5,704,321 both issued to Suckewer et al. The '733 Patent discloses a conventional ignition system which provides the high voltage necessary to break down the gap of the spark plug, in combination with the secondary power source that includes a voltage source and other circuitry to provide high power input to the spark gap once the conducting path there across (i.e., the plasma) has been established by the standard ignition system. A low resistance must be used between the high power source and the spark gap or a significant amount of energy would be lost. Accordingly, due to the low resistance, these systems require significant electrical shielding to operate without RFI. This shielding can reduce RFI, but does nothing to protect the secondary winding of the ignition coil from problems associated with wire to wire shorts.

Accordingly, there is a need for an ignition apparatus that minimizes or eliminates one or more of the problems set forth above.

SUMMARY OF THE INVENTION

It is an object of the present invention to minimize or eliminate one or more of the problems set forth in the Background. An ignition system according to the present invention overcomes shortcomings of a conventional ignition system of the type having (i) a conventional ignition coil to breakdown the spark gap and (ii) a secondary power source to sustain discharge after breakdown by including an impedance device in series with an output of the ignition coil (i.e., the secondary winding). An ignition system for use with a spark plug in an internal combustion engine and includes an ignition apparatus for producing a breakdown voltage on a first output thereof configured to breakdown a spark gap of the spark plug, a power source having a second output configured for connection to the spark plug, the source being further configured to provide power to the spark gap to sustain discharge phase after said gap breakdown, an impedance having first and second terminals coupled between the first and second outputs, the impedance having electrical characteristic configured to allow application of said breakdown voltage and suppress high voltage transient current on the secondary winding of the ignition apparatus.

BRIEF DESCRIPTION OF THE DRAWINGS

The present invention will now be described by way of example, with reference to the accompanying drawings, in which.

DETAILED DESCRIPTION OF THE PREFERRED EMBODIMENTS

Figure 1:
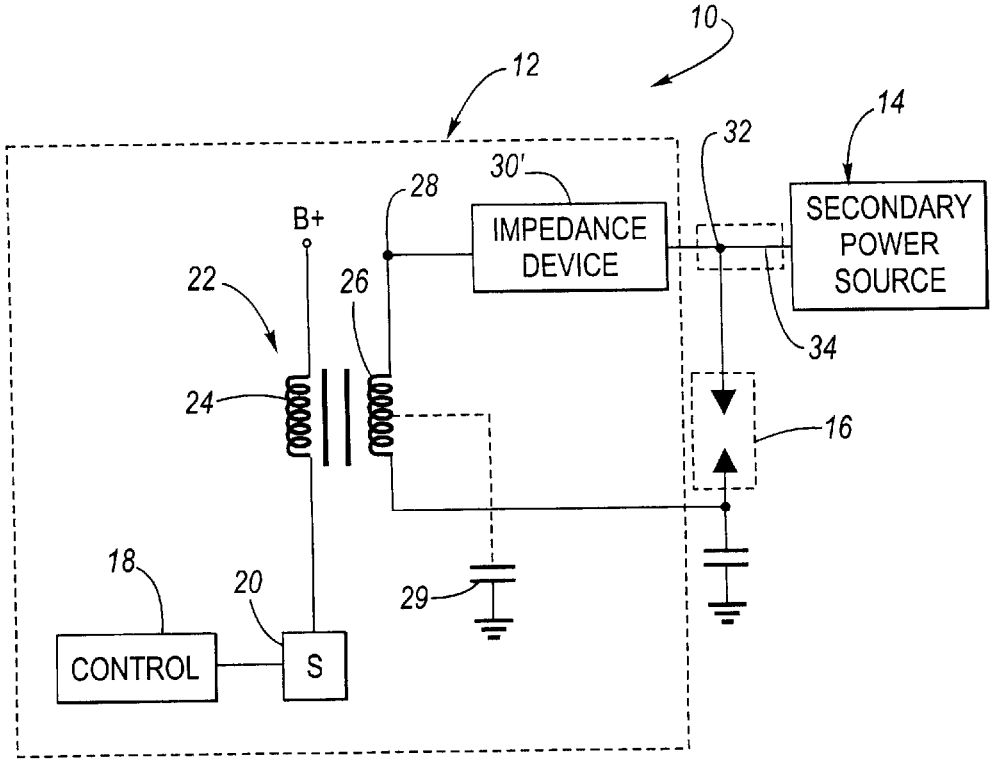
FIG. 1 is a simplified schematic diagram illustrating an impedance apparatus used in accordance with the present invention.

Referring now to the drawings wherein like reference numerals are used to identify identical components, FIG. 1 is a simplified schematic representation of an ignition system 10 according to the present invention. Ignition system 10 includes an ignition apparatus 12, a secondary power source 14 and a spark plug 16. Ignition apparatus 12 is configured to produce a breakdown voltage to the spark plug 16. Ignition apparatus 12 includes a control unit 18, a switch 20, an ignition coil 22 and an impedance device 30. As further background, control unit 18 is configured generally to perform a plurality of functions, including generation of an ignition control signal EST (electronic spark timing). It should be understood that the ignition control signal EST may be generated or initiated by other control units not shown, such as a powertrain control module (PCM) in accordance with known ignition control strategies, and provided to control unit 18, such that control unit 18 responds by driving switch 20 to closure in response thereto. As known, the ignition control signal defines the initial charging time (e.g., duration), and the relative timing (e.g., relative to cylinder top dead center) of when a spark is to occur.

Ignition coil 22 consists of two windings, a primary winding 24 and a secondary winding 26. Switch 20 is configured to selectively connect primary winding 24 to ground, responsive to the ignition control signal. Such a connection to ground, as is known generally in the art, will cause a primary current $I_p$ to flow through primary winding 24. Switch 20 is illustrated in the Figure as a block diagram; however, it should be understood that switch 20 may include conventional components known to those of ordinary skill in the art, such as, for purposes of example only, an insulated gate bipolar transistor (IGBT). When the ignition control signal is discontinued, switch 20 is opened up thereby interrupting the primary current. A voltage rise occurs across the secondary winding 26, a high voltage end of which is coupled to spark plug 16 through connection point 28. The spaced electrodes of spark plug 16 (defining a gap therebetween) is shown. The induced voltage continues to rise across this gap until breakdown occurs, resulting in an electrical discharge across the gap (i.e., the spark).

Figure 2:
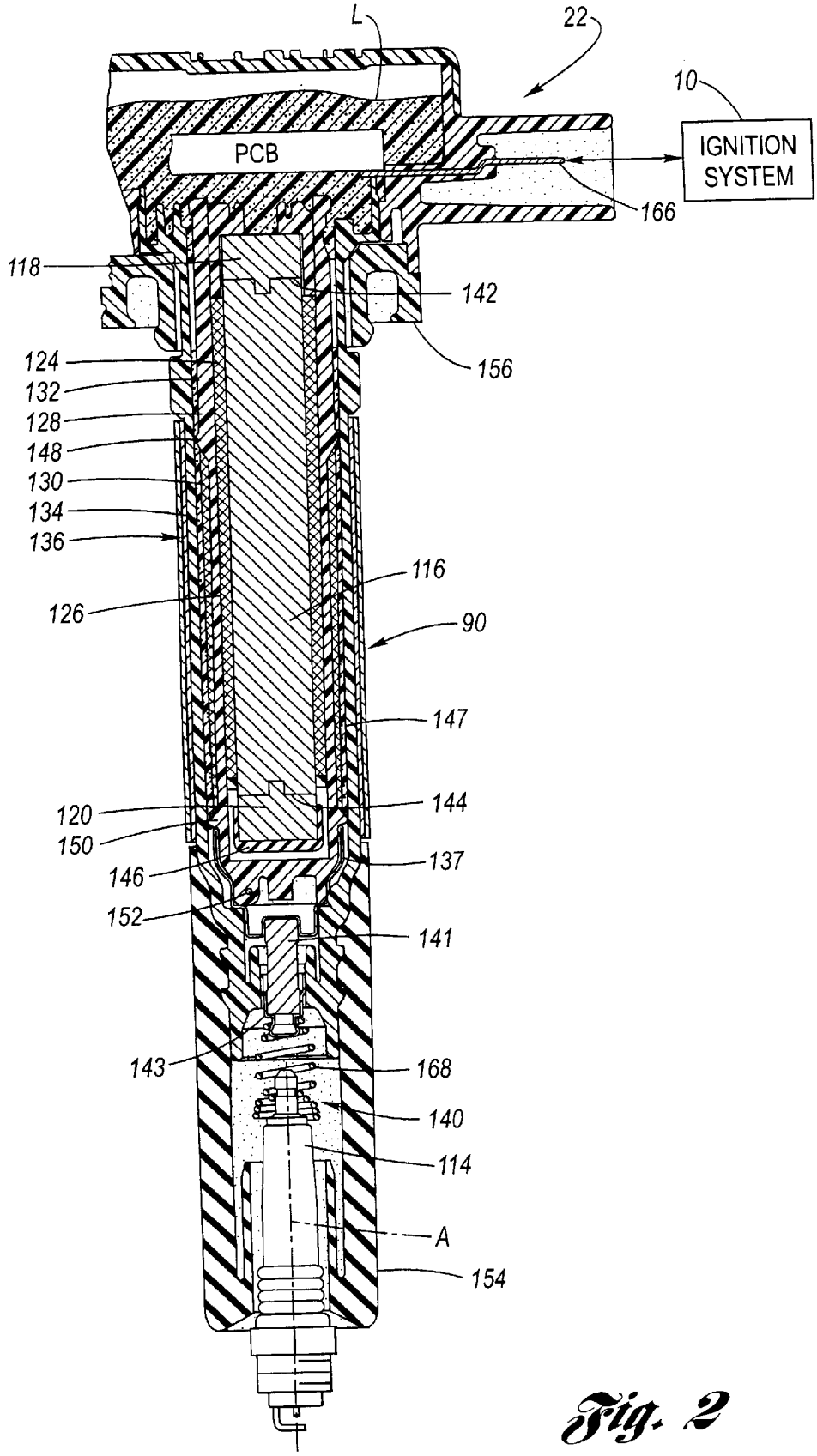
FIG. 2 is a simplified, cross-sectional view showing, in greater detail, an exemplary ignition coil portion of an ignition apparatus.

A conventional arrangement for an ignition coil is shown in FIG. 2. Note that the stack of components, moving inside to outside, include a central core 116, a primary winding spool (not shown) having a primary winding 124 wound thereon, a secondary winding spool 128 with a secondary winding 130 wound thereon, a layer 132 of encapsulant such as an epoxy resin material, a case 134 of electrical insulating material, and a shield 136 generally formed of a suitable magnetic material, such as silicon steel.

In the conventional configuration, the outer shield 136 is grounded. Moreover, it warrants noting that both the layer 132 and the case 134 are dielectric materials. Accordingly, the secondary winding 130 of ignition coil 90 has a capacitance 29 associated therewith.

Referring again to FIG. 1, capacitance 29 is shown in phantom line format, to note that it practically speaking is present, although no discrete capacitor component is actually included in the ignition coil. This capacitance 29 arises from the sequence of the secondary winding, the two dielectric materials (i.e., epoxy layer and the case), and the grounded shield, which form, as one of ordinary skill in the art will recognize, a "capacitor". The capacitance 29 associated with the secondary winding 26 is charged when the ignition coil 22 is turned off due to energy stored and transferred from the primary to the second winding when the switch is turned off (i.e., opened).

But for the impedance element 30 according to the present invention, when the gap breaks down (i.e., ionizes), capacitance 29 would discharge quickly, via a short. The rapid discharge would exacerbate the wire-to-wire shorting described in the Background. However, the impedance element 30 of the present invention operates to impede or slow down the discharge of capacitance 29. This feature of the present invention operates to reduce the wire to wire shorting.

Ignition apparatus 12 further includes impedance device 30 connected in series with the secondary winding 26. Impedance device 30 is designed to have an electrical characteristic configured to permit application of the breakdown voltage and suppress a high voltage transient current at connection point 28. As mentioned earlier, as ignition coil 22 is located closer to the spark plug 16, the voltage discharge may lead to generation of high voltage transients causing wire to wire shorts in the secondary winding 26. According to the invention, however, impedance device 30 is configured to allow high voltage breakdown at the gap yet suppress power transfer current from the breakdown of the spark gap.

For completeness sake, a complete description of an ignition coil 90 suitable for use with the present invention will now be set forth.

Referring once again to FIG. 2, further details concerning an exemplary ignition coil 90 will now be set forth. It should be understood that portions of the following are exemplary only and not limiting in nature. Many other configurations of coil 90 are known to those of ordinary skill in the art and are consistent with the teachings of the present invention, which relate principally to the inventive connection arrangement. Nonetheless, the following may be taken as a non-limiting illustrated embodiment.

Central core 116 may be elongated, having a main, longitudinal axis "A" associated therewith. Core 116 includes an upper, first end 142, and a lower, second end 144. Core 116 may be a conventional core known to those of ordinary skill in the art. As illustrated, core 116, in the preferred embodiment, takes a generally cylindrical shape (which is a generally circular shape in radial cross-section), and may comprise compression molded insulated iron particles or laminated steel plates, both as known.

Magnets 118 and 120 may be optionally included in ignition coil 90 as part of the magnetic circuit, and provide a magnetic bias for improved performance. The construction of magnets such as magnets 118 and 120, as well as their use and effect on performance, is well understood by those of ordinary skill in the art. It should be understood that magnets 118 and 120 are optional in ignition coil 90, and may be omitted, albeit with a reduced level of performance, which may be acceptable, depending on performance requirements.

A rubber buffer cup 146 may be included.

Primary winding 124 may be wound directly onto core 116 in a manner known in the art. Primary winding 124 includes first and second ends and is configured to carry a primary current $I_p$ for charging coil 90 upon control of ignition system 10. Winding 124 may be implemented using known approaches and conventional materials. Although not shown, primary winding 124 may be wound on a primary winding spool (not shown) in certain circumstances (e.g., when steel laminations are used). In addition, winding 124 may be wound on an electrically insulating layer that is itself disposed directly on core 116.

Layers 126 and 132 comprise an encapsulant suitable for providing electrical insulation within ignition coil 90. In a preferred embodiment, the encapsulant comprises epoxy potting material. The epoxy potting material introduced in layers 126, and 132 may be introduced into annular potting channels defined (i) between primary winding 124 and secondary winding spool 128, and, (ii) between secondary winding 130 and case 134. The potting channels are filled with potting material, in the illustrated embodiment, up to approximately the level designated "L" in FIG. 2. In one embodiment, layer 126 may be between about 0.1 mm and 1.0 mm thick. Of course, a variety of other thicknesses are possible depending on flow characteristics and insulating characteristics of the encapsulant and the design of the coil 90. The potting material also provides protection from environmental factors which may be encountered during the service life of ignition coil 90. There is a number of suitable epoxy potting materials well known to those of ordinary skill in the art.

Secondary winding spool 128 is configured to receive and retain secondary winding 130. Spool 128 is disposed adjacent to and radially outwardly of the central components comprising core 116, primary winding 124, and epoxy potting layer 126, and, preferably, is in coaxial relationship therewith. Spool 128 may comprise any one of a number of conventional spool configurations known to those of ordinary skill in the art. In the illustrated embodiment, spool 128 is configured to receive one continuous secondary winding (e.g., progressive winding) on an outer winding surface thereof, between upper and lower flanges 148 and 150 ("winding bay"), as is known. However, it should be understood that other configurations may be employed, such as, for example only, a configuration adapted for use with a segmented winding strategy (e.g., a spool of the type having a plurality of axially spaced ribs forming a plurality of channels therebetween for accepting windings) as known.

The depth of the secondary winding in the illustrated embodiment may decrease from the top of spool 128 (i.e., near the upper end 142 of core 116), to the other end of spool 128 (i.e., near the lower end 144) by way of a progressive gradual flare of the spool body. The result of the flare or taper is to increase the radial distance (i.e., taken with respect to axis "A") between primary winding 124 and secondary winding 130, progressively, from the top to the bottom. As is known in the art, the voltage gradient in the axial direction, which increases toward the spark plug end (i.e., high voltage end) of the secondary winding, may require increased dielectric insulation between the secondary and primary windings, and, may be provided for by way of the progressively increased separation between the secondary and primary windings.

Spool 128 is formed generally of electrical insulating material having properties suitable for use in a relatively high temperature environment. For example, spool 128 may comprise plastic material such as PPO/PS (e.g., NORYL available from General Electric) or polybutylene terephthalate (PBT) thermoplastic polyester. It should be understood that there are a variety of alternative materials that may be used for spool 128 known to those of ordinary skill in the ignition art, the foregoing being exemplary only and not limiting in nature.

Features 148 and 150 may be further configured so as to engage an inner surface of case 134 to locate, align, and center the spool 128 in the cavity of case 134 and providing upper and lower defining features for a winding surface therebetween.

Spool 128 has associated therewith an electrically conductive (i.e., metal) high-voltage (HV) terminal 152 disposed therein configured to engage cup 137, which cup is in turn electrically connected to the HV connector assembly 140. The body of spool 128 at a lower end thereof is configured so as to be press-fit into the interior of cup 137 (i.e., the spool gate portion).

FIG. 2 also shows secondary winding 130 in cross-section. Secondary winding 130, as described above, is wound on spool 128, and includes a low voltage end and a high voltage end. The low voltage end may be connected to ground by way of a ground connection through LV system connector body 22 in a manner known to those of ordinary skill in the art. The high voltage end is connected to HV terminal 152. Winding 130 may be implemented using conventional approaches and material known to those of ordinary skill in the art.

Case 134 includes an inner, generally enlarged cylindrical surface, an outer surface, a first annular shoulder, a flange, an upper through-bore, and a lower through bore.

The inner surface of case 134 is configured in size to receive and retain spool 128 which contains the core 116 and primary winding 124. The inner surface of case 134 may be slightly spaced from spool 128, particularly the annular features 148, 150 thereof (as shown), or may engage the features 148, 150.

A lower through-bore is defined by an inner surface of case 134 configured in size and shape (i.e., generally cylindrical) to accommodate an outer surface of cup 137 at a lowermost portion thereof as described above. When the lowermost body portion of spool 128 is inserted in the lower bore containing cup 137, a portion of HV terminal 152 engages an inner surface of cup 137 (also via a press fit).

Case 134 is formed of electrical insulating material, and may comprise conventional materials known to those of ordinary skill in the art (e.g., the PBT thermoplastic polyester material referred to above).

Shield 136 is generally annular in shape and is disposed radially outwardly of case 134, and, preferably, engages an outer surface of case 134. The shield 136 preferably comprises electrically conductive material, and, more preferably metal, such as silicon steel or other adequate magnetic material. Shield 136 provides not only a protective barrier for ignition coil 90 generally, but, further, provides a magnetic path for the magnetic circuit portion of ignition coil 90. Shield 136 may be grounded by way of an internal grounding strap, finger or the like (not shown) well know to those of ordinary skill in the art. Shield 136 may comprise multiple, individual sheets 136, as shown.

Low voltage system connector body 22 is configured to, among other things, electrically and selectively connect the first and second ends of primary winding 124 via PCB 24 as described above to an energization source, such as, the energization circuitry (e.g., power source) included in ignition system 16. Connector 22 also provides in-part, a mechanism for grounding the LV end of secondary winding. System connector body 22 is generally formed of electrical insulating material, but also includes a plurality of electrically conductive output terminals 166 (e.g., pins for ground, primary winding leads, etc.). Terminals 166 are coupled electrically, internally through connector body 22 via PCB 24.

HV connector assembly 140 is provided for establishing an electrical connection to spark plug 114. Assembly 140 may include an inductive resistor 141, a second conductive cup 143 and a spring contact 168 or the like. Resistor 141 may be provided to combat electromagnetic interference (EMI). Second cup 143 provides for a transition to spring 168. Cup 143 may include an annular projection configured to allow spring 168 to be coupled thereto. Contact spring 168 is in turn configured to engage a high-voltage connector terminal of spark plug 114. This arrangement for coupling the high voltage developed by secondary winding 130 to plug 114 is exemplary only; a number of alternative connector arrangements, particularly spring-biased arrangements, are known in the art.

Figure 3:
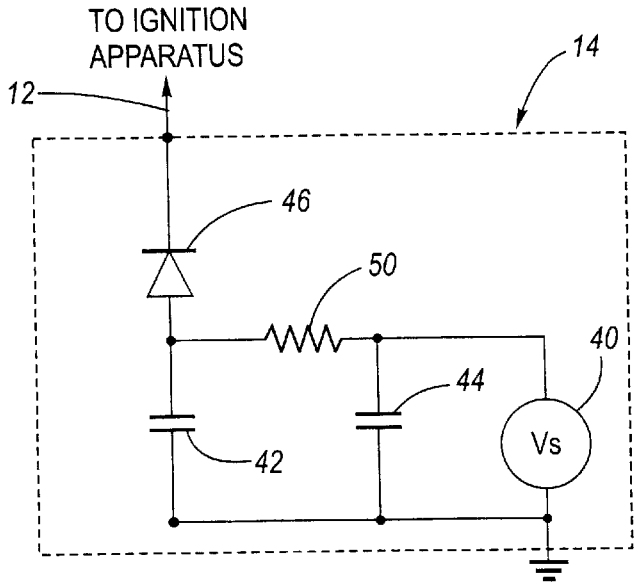
Prior Art Fig. 3
FIG. 3 is a schematic and a block diagram of a secondary power source used in accordance with the present invention.

Referring now to FIG. 3, a schematic and block diagram of the secondary power source 14. Secondary power source 14 may comprise conventional capacitors and configuration known to those of ordinary skill in the art. FIG. 3 shows such an exemplary configuration, and includes a low voltage supply source 40, capacitors 42, 44, diode 46 and resistor 50. The conventional ignition apparatus (not shown) provides the high voltage necessary to breakdown the gap of spark plug (not shown). Once the conducting path has been established, capacitor 42 quickly discharges through diode 46 providing high power input into the spark plug. Diode 46 is necessary to isolate electrically the ignition coil (not shown) of the conventional ignition system from the relatively large capacitor 44. If the diode 46 were not present, the coil would not be able to produce a high voltage, due to the low impedance provided by the capacitor 42. The coil would instead charge the capacitor 42. The function of resistor 50, capacitor 44 and the voltage source 40 is to recharge the capacitor 42 after the discharge cycle. The resistor 50 is one way to prevent a low resistance current path between the voltage source 40 and the spark gap (not shown).

An ignition apparatus in accordance with the present invention includes an impedance device connected in series with the secondary winding.

It will be understood that the above description is merely exemplary rather than limiting in nature, the invention being limited only by the appended claims. Various modifications and changes may be made thereto by one of ordinary skill in the art, which embody the principals of the invention and fall within the spirit and scope thereof.

What is claimed is:

1. An ignitions system for use with a spark plug in an internal combustion engine comprising:

an ignition apparatus for producing a breakdown voltage on a first output thereof configured to breakdown a spark gap of the spark plug;

a power source having a second output configured for connection to the spark plug, said source being further configured to provide power to said spark gap to sustain discharge phase after said gap breakdown;

an impedance having first and second terminals coupled between said first and second outputs, said impedance having an electrical characteristic configured to allow application of said breakdown voltage and suppress high voltage transient current on a secondary winding of said ignition apparatus.

2. The ignitions system of claim 1 wherein said impedance comprises an electrical resistance between 1 k ohms and 100 k ohms.

3. The ignition system of claim 1 wherein said impedance comprises a resistance to suppress transient current forming from said breakdown of said spark gap and configured to allow passage of said breakdown voltage.

4. The ignition system of claim 1 wherein said power source comprises a charged capacitor.

5. The ignition system of claim 1 wherein said ignition apparatus comprises a coil with a primary winding and said secondary winding wherein said secondary winding is in series with said impedance.

6. An ignition system for use with a spark plug in an internal combustion engine comprising:

an impedance device comprising an electrical resistance between 1 k ohms and 100 k ohms wherein said impedance device further comprises a resistance to suppress transient current forming from said breakdown of said spark gap and configured to allow passage of said breakdown voltage;

a power source configured for connection to a spark plug, said power source comprising a charged capacitor; and an ignition apparatus comprising a primary winding and a secondary winding wherein said secondary winding is in series with said impedance device.

* * * * *